US010594084B2

(12) United States Patent
Ikegami et al.

(10) Patent No.: US 10,594,084 B2
(45) Date of Patent: Mar. 17, 2020

(54) ELECTRICAL CONNECTOR HAVING AN ACTUATOR STRUCTURE

(71) Applicant: KYOCERA CORPORATION, Kyoto (JP)

(72) Inventors: Fumihito Ikegami, Funabashi (JP); Masafumi Seki, Kawasaki (JP); Ryoichi Manabe, Kyoto (JP)

(73) Assignee: KYOCERA CORPORATION, Kyoto (JP)

( * ) Notice: Subject to any disclaimer, the term of this patent is extended or adjusted under 35 U.S.C. 154(b) by 14 days.

(21) Appl. No.: 15/776,049

(22) PCT Filed: Nov. 18, 2016

(86) PCT No.: PCT/JP2016/084363
§ 371 (c)(1),
(2) Date: May 14, 2018

(87) PCT Pub. No.: WO2017/086475
PCT Pub. Date: May 26, 2017

(65) Prior Publication Data

US 2018/0323546 A1 Nov. 8, 2018

(30) Foreign Application Priority Data

Nov. 19, 2015 (JP) ..... 2015-226677

(51) Int. Cl.
*H01R 13/15* (2006.01)
*H01R 13/62* (2006.01)
(Continued)

(52) U.S. Cl.
CPC ..... *H01R 13/641* (2013.01); *H01R 12/79* (2013.01); *H01R 12/88* (2013.01)

(58) Field of Classification Search
CPC ..... H01R 12/88; H01R 12/79; H01R 23/684; H01R 23/68; H01R 13/641
(Continued)

(56) References Cited

U.S. PATENT DOCUMENTS 7,695,299 B2 * 4/2010 Tanaka ..... H01R 12/79 439/260
8,177,570 B2 5/2012 Tanaka et al.
(Continued)

FOREIGN PATENT DOCUMENTS

CN 101276964 A 10/2008
JP 2002-124331 A 4/2002
(Continued)

OTHER PUBLICATIONS

International Search Report dated Jan. 10, 2017, in counterpart Japanese International Application No. PCT/JP2016/084363.

*Primary Examiner* — Abdullah A Riyami
*Assistant Examiner* — Thang H Nguyen
(74) *Attorney, Agent, or Firm* — Duane Morris LLP

(57) ABSTRACT

A connector that, when changing an actuator from an open state to a closed state provides a sound that indicates the actuator has changed to a fully closed state. In one embodiment, the actuator has an open surface, a closed surface, a sloped connection surface, and a tip load transmission portion. The open surface enables insertion of a connection object into an insertion portion in an open state. The closed surface is approximately parallel to the connection object in a closed state. The sloped connection surface connects the open surface and the closed surface. The tip load transmission portion is located at an intersection of the closed surface and the sloped connection surface, and elastically contacts the connection object at a time at which a pressing load imparted by an elastic pressing portion is at a peak.

8 Claims, 10 Drawing Sheets

(51) Int. Cl.
*H01R 13/641* (2006.01)
*H01R 12/79* (2011.01)
*H01R 12/88* (2011.01)

(58) Field of Classification Search
USPC ..... 439/260, 495, 329
See application file for complete search history.

(56) References Cited

U.S. PATENT DOCUMENTS 8,622,766 B2 * 1/2014 Yokoo ..... H01R 12/775 439/260
2006/0089045 A1 * 4/2006 Miura ..... H01R 12/88 439/495
2008/0242131 A1 * 10/2008 Tanaka ..... H01R 12/79 439/138
2008/0242143 A1 * 10/2008 Tanaka ..... H01R 12/79 439/499
2010/0197158 A1 8/2010 Tanaka et al.
2010/0304594 A1 * 12/2010 Yokoo ..... H01R 12/88 439/325
2011/0151682 A1 * 6/2011 Kodaira ..... H01R 12/594 439/55
2011/0201220 A1 * 8/2011 Taketomi ..... H01R 12/79 439/329
2011/0237106 A1 * 9/2011 Wada ..... H01R 12/79 439/329
2013/0023142 A1 * 1/2013 Sasaki ..... H01R 12/592 439/325
2013/0065417 A1 * 3/2013 Kurachi ..... H01R 12/772 439/325

FOREIGN PATENT DOCUMENTS

JP 2011233487 A 11/2011
JP 5123976 B2 1/2013

* cited by examiner

ELECTRICAL CONNECTOR HAVING AN ACTUATOR STRUCTURE

TECHNICAL FIELD

The present disclosure relates to a connector that is connected to a flat connection object such as a flexible printed circuit (FPC) or a flexible flat cable (FFC).

BACKGROUND

This type of connector includes, as a basic structure: an insulator into which a connection object is inserted; a contact supported by the insulator and electrically connectable to the connection object inserted in the insulator; an actuator supported by the insulator so as to be rotatable (openable/closable); and an elastic pressing portion that acts on a rotation shaft of the actuator to press the actuator toward the connection object.

CITATION LIST

Patent Literature

PTL 1: JP 2002-124331 A

SUMMARY

Technical Problem

For such connectors, there is a market requirement that, when changing the actuator from an open state to a closed state, it is easy to recognize visually or aurally that the actuator has changed to a fully closed state. Visually, whether the actuator has changed to a fully closed state is determined based on the position and angle of the actuator. This determination is, however, difficult for recent connectors which are lighter and more compact. If it is aurally recognizable that the actuator has changed to a fully closed state even in a noisy factory, operation can be performed advantageously. However, no conventional connectors allow for easy aural recognition that the actuator has changed to a fully closed state.

Conventional connectors also have a problem of poor actuator operability, because an operator needs to manually press the actuator in order to change the actuator to a fully closed state. It is therefore desirable to improve actuator operability when changing the actuator from an open state to a closed state, while maintaining the basic performance of the connector.

It would therefore be helpful to provide a connector that, when changing an actuator from an open state to a closed state, allows for easy aural recognition that the actuator has changed to a fully closed state, and also has improved actuator operability.

Solution to Problem

A connector according to the present disclosure is a connector comprising: an insulator having an insertion portion into which a flat connection object is inserted; a contact supported by the insulator, and electrically connectable to the connection object inserted in the insertion portion; an actuator rotatably supported by the insulator, and having an open surface that enables insertion of the connection object into the insertion portion in an open state, and a closed surface approximately parallel to the connection object in a closed state; and an elastic pressing portion that acts on a rotation shaft of the actuator, to press the actuator toward the connection object inserted in the insertion portion, wherein the actuator has: a sloped connection surface that connects the open surface and the closed surface; and a tip load transmission portion that is located at an intersection of the closed surface and the sloped connection surface, and elastically contacts the connection object at a time at which a pressing load imparted by the elastic pressing portion is at a peak.

When changing the actuator from the open state to the closed state, the tip load transmission portion may be located below the rotation shaft of the actuator in an intermediate open/close state in which the open surface is approximately orthogonal to the connection object.

In a state in which the tip load transmission portion elastically contacts the connection object, a wedged space may be formed between the closed surface and the connection object.

The sloped connection surface may intersect with the open surface at an obtuse angle, and intersect with the closed surface at an approximately right angle.

The sloped connection surface may intersect with each of the open surface and the closed surface at an obtuse angle.

The contact may include a plurality of contacts arranged side by side in a predetermined direction, and the open surface, the closed surface, the sloped connection surface, and the tip load transmission portion of the actuator may be provided in interpolar walls located between adjacent contacts in the plurality of contacts.

The open surface, the closed surface, the sloped connection surface, and the tip load transmission portion of the actuator may be provided on all of the plurality of interpolar walls.

The open surface, the closed surface, the sloped connection surface, and the tip load transmission portion of the actuator may be provided on some of the plurality of interpolar walls.

The open surface may enable the insertion of the connection object into the insertion portion with a zero insertion force (ZIF) in the open state.

Advantageous Effect

It is thus possible to obtain a connector that, when changing an actuator from an open state to a closed state, allows for easy aural recognition that the actuator has changed to a fully closed state, and also has improved actuator operability.

DETAILED DESCRIPTION

Figure 1:
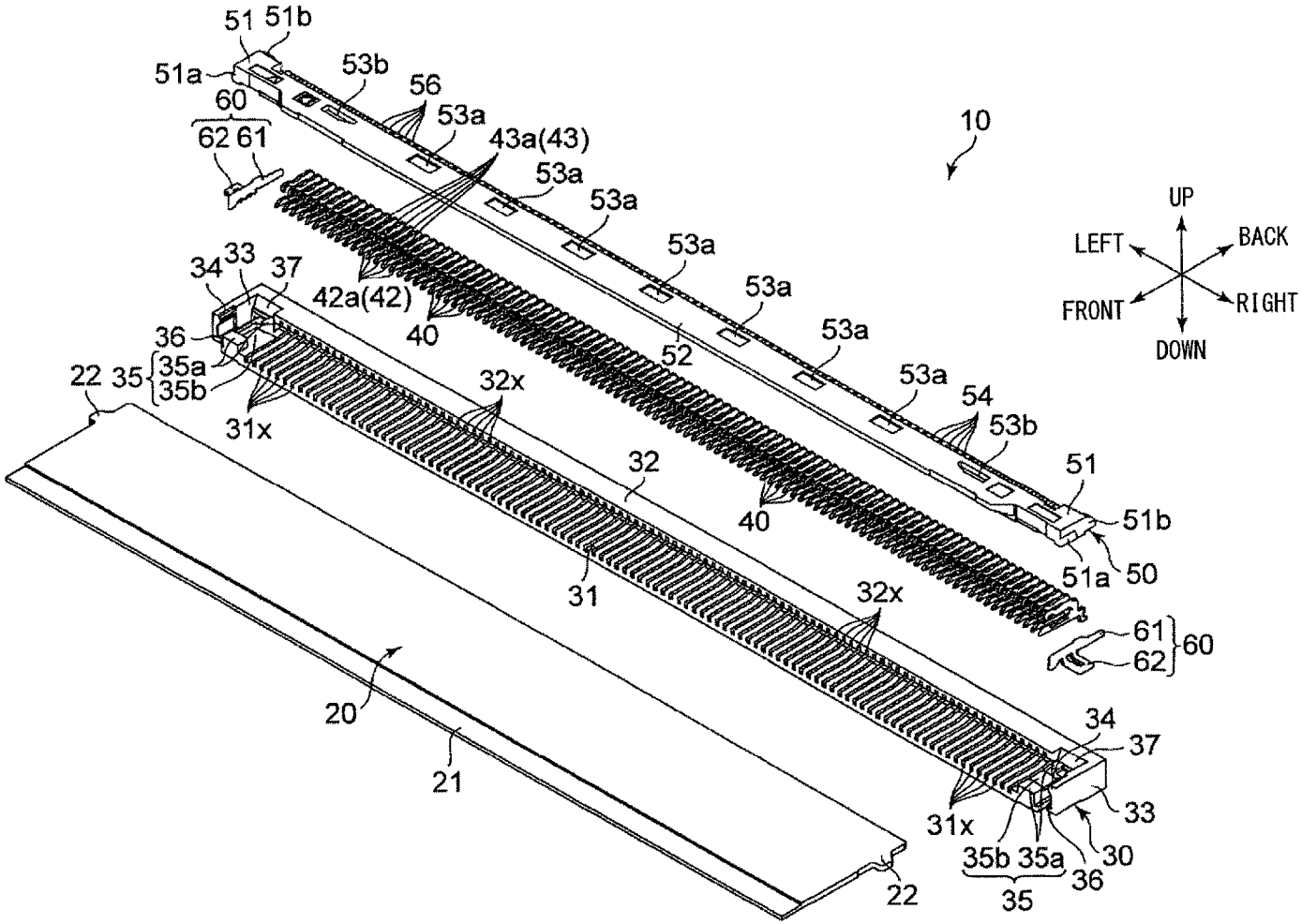
FIG. 1 is an exploded perspective view of a connector and a connection object according to an embodiment.

A connector 10 according to an embodiment is described below, with reference to FIGS. 1 to 14. The connector 10 is connected to a flat connection object 20 such as a flexible printed circuit (FPC) or a flexible flat cable (FFC). The directions (front, back, up, down, right, left) in the following description are based on the respective arrow directions in the drawings. In the drawings, the back direction corresponds to the "insertion direction" of the connection object 20 into the connector 10, the front direction corresponds to the "removal direction" of the connection object 20 from the connector 10, and the right-left direction corresponds to the "predetermined direction orthogonal to the insertion/removal direction" of the connection object 20 with respect to the connector 10.

The connection object 20 is composed of a sheet member (film member) that is approximately rectangular in planar view and is short in the front-back direction and long in the right-left direction. The connection object 20 has a thin portion 21 obtained by making only a front part of the upper surface thinner than the other parts. The connection object 20 has a pair of engaging pieces 22 projecting outward from the right and left surfaces near the back. The connection object 20 has 100 circuit patterns (not illustrated) arranged side by side in the right-left direction (predetermined direction), on the lower surface near the back.

The connector 10 includes an insulator 30, 100 contacts 40 arranged side by side in the right-left direction (predetermined direction), an actuator 50, and a pair of fixed metal fittings 60 located on the right and left sides.

The insulator 30 is formed by injection molding an insulating and heat-resistant resin material (synthetic resin material). An insertion portion 31 into which the connection object 20 is inserted from the front is formed in a front part of the upper surface of the insulator 30. The length of the insertion portion 31 in the right-left direction is approximately equal to the length of the connection object 20 in the right-left direction. The insulator 30 has a roof portion 32 projecting forward from the upper end of the back wall of the insulator 30 and facing the back of the insertion portion 31.

100 contact support grooves 31X, each extending in the front-back direction, are arranged side by side in the right-left direction (predetermined direction) on the upper surface of the insertion portion 31. Each contact support groove 31X has a front part open to the front end of the insertion portion 31, and a back part reaching the back surface of the insulator 30.

100 contact support grooves 32X, each extending in the front-back direction, are arranged side by side in the right-left direction (predetermined direction) on the lower surface of the roof portion 32, in association with the 100 contact support grooves 31X. Each contact support groove 32X has a front part open to the front end of the roof portion 32, and a back part reaching the back surface of the insulator 30.

A pair of side walls 33 are located on the right and left sides of the insertion portion 31 and the roof portion 32, at the right and left ends of the insulator 30. A pair of engagement projections 34 are each formed in a front part of the inner surface of the corresponding one of the pair of side walls 33. A pair of actuator support portions 35 are located inward from the pair of side walls 33. Each actuator support portion 35 has a pair of upward projecting portions 35*a* separate in the front-back direction, and an engaging portion 35*b* between the pair of upward projecting portions 35*a*. A pair of fixed metal fitting support grooves 36 are each formed between the side wall 33 and the actuator support portion 35, on the right and left sides. A sloped surface 37 that slopes toward the upper back is located backward from the pair of actuator support portions 35.

The contacts 40 are formed into the illustrated shape from a sheet of a copper alloy (e.g. phosphor bronze, beryllium copper, titanium copper) or a corson copper alloy having spring elasticity using progressive dies (stamping). The surfaces of the contacts 40 are coated with nickel to form a base, and then coated with gold.

Figure 6:
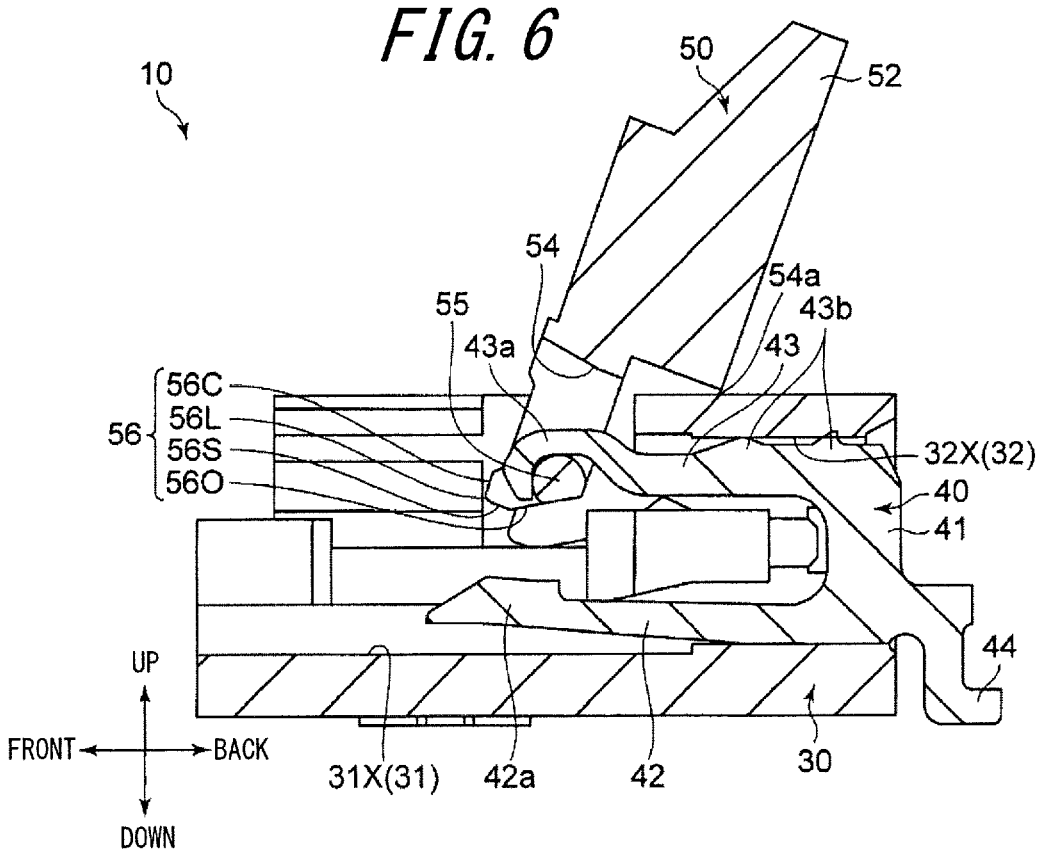
FIG. 6 is a sectional view along line VI-VI in FIG. 2.
Figure 7:
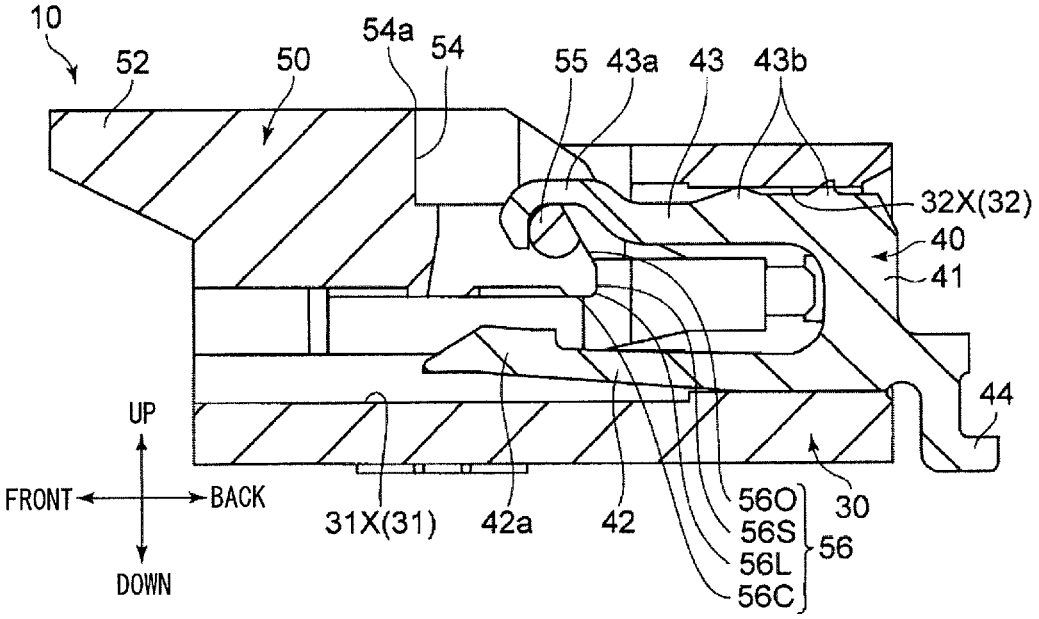
FIG. 7 is a sectional view along line VII-VII in FIG. 4.

As illustrated in FIGS. 6, 7, etc., each contact 40 is approximately U-shaped in cross section, and includes: a base piece 41 forming the back end and extending in the up-down direction; a connection object support arm (hereafter simply referred to as "support arm") 42 extending forward from the lower end of the base piece 41 and elastically deformable in the up-down direction; and a press arm (stabilizer) 43 extending forward from the upper end of the base piece 41 and elastically deformable in the up-down direction.

The front part of the connection object 20 can be inserted into the space approximately U-shaped in cross section of the contact 40. A contact portion 42*a* extending obliquely upward is formed at the front end of the support arm 42. Although the upper end surface of the contact portion 42*a* takes a flat shape in FIGS. 6, 7, etc., more precisely the upper end surface of the contact portion 42*a* has an approximately valley shape composed of a front sloped surface sloped downward from the front toward the back, a back sloped surface sloped downward from the back toward the front, and a recess connecting the front sloped surface and the back sloped surface near the center part in the front-back direction. An approximately semicircular arc-shaped rotation shaft support portion (elastic pressing portion) 43*a* having an opening in the lower part is formed at the front end of the press arm 43. Two engaging protrusions 43*b* projecting upward are formed in the press arm 43 near the back. A tail portion 44 located on the opposite side to the support arm 42 and projecting downward and then extending backward is formed at the lower end of the base piece 41.

The contact 40 is inserted into the contact support groove 31X and the contact support groove 32X of the insulator 30 from the back and supported. In this support state, the support arm 42 is supported along the contact support groove 31X of the insertion portion 31, and the press arm 43 is supported along the contact support groove 32X of the roof portion 32. Here, the two engaging protrusions 43*b* of the press arm 43 dig into and are caught by the contact support groove 32X of the roof portion 32. The contact portion 42*a* at the front end of the support arm 42 projects upward from the contact support groove 31X of the insertion portion 31. The rotation shaft support portion 43*a* at the front end of the press arm 43 projects forward from the contact support groove 32X of the roof portion 32. The tail portion 44 is soldered to a circuit board (not illustrated) on which the connector 10 is to be mounted.

The actuator 50 is formed by injection molding an insulating and heat-resistant resin material (synthetic resin material), and is a plate-like member extending in the right-left direction. A pair of supported portions 51, to be supported by the pair of actuator support portions 35 formed at the right and left ends of the insulator 30, are formed at the right and left ends of the actuator 50. Each supported portion 51 has an engagement projection 51*a* projecting outward from the right and left surfaces, and an R-shaped portion 51*b* rounded toward the upper back. The actuator 50 has a picking portion 52 projecting from its front end. The actuator 50 has seven rectangular recesses 53*a* arranged side by side in the right-left direction (predetermined direction) and two trapezoidal recesses 53*b* located on both sides of the seven rectangular recesses 53*a*, at the corresponding positions (same positions) of its upper surface and lower surface. These rectangular recesses 53*a* and trapezoidal recesses 53*b* have a function of suppressing warpage or distortion when forming the actuator 50.

Figure 2:
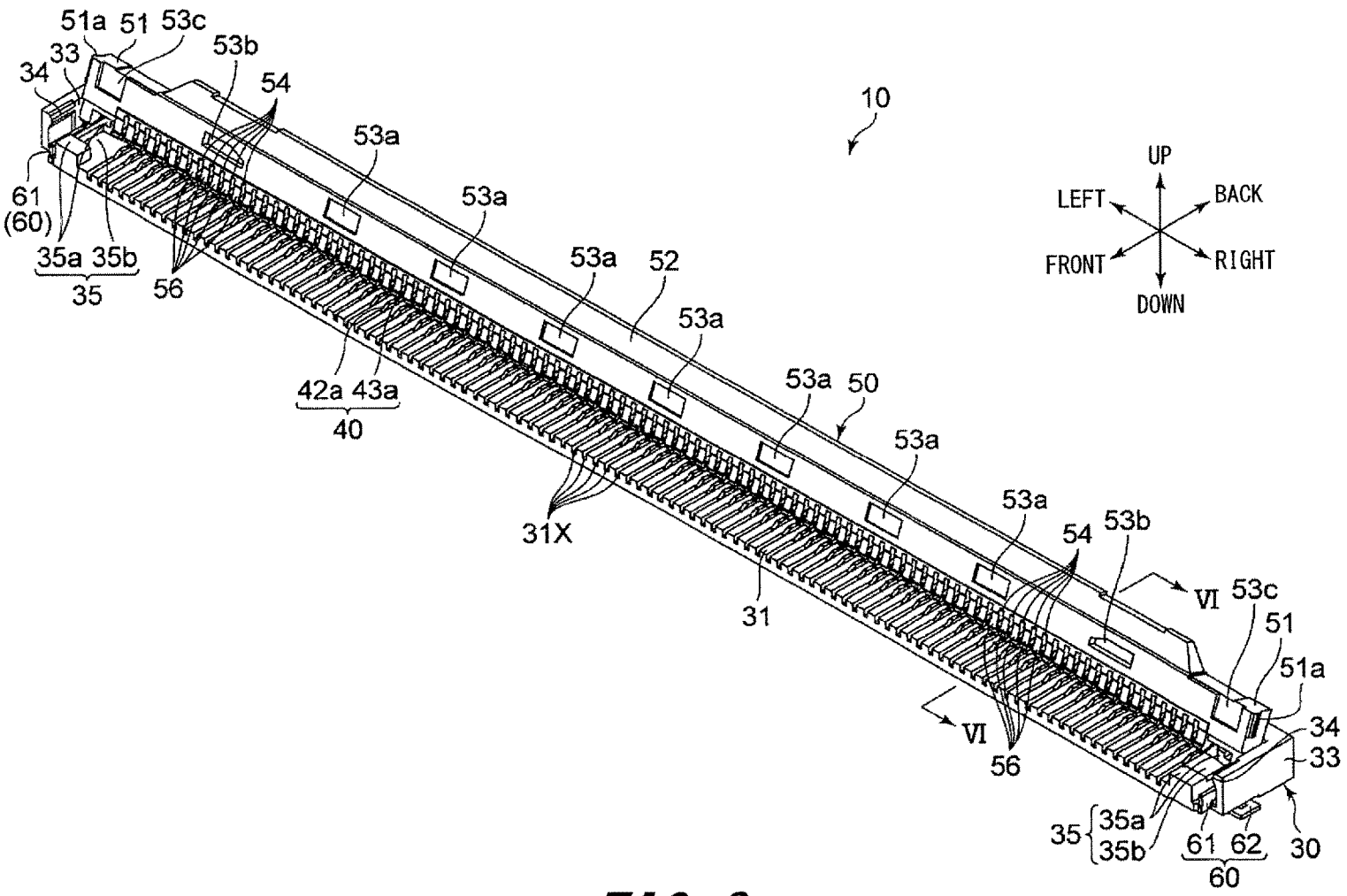
FIG. 2 is a perspective view of the connector with an actuator in a fully open state, as seen from the front.
Figure 3:
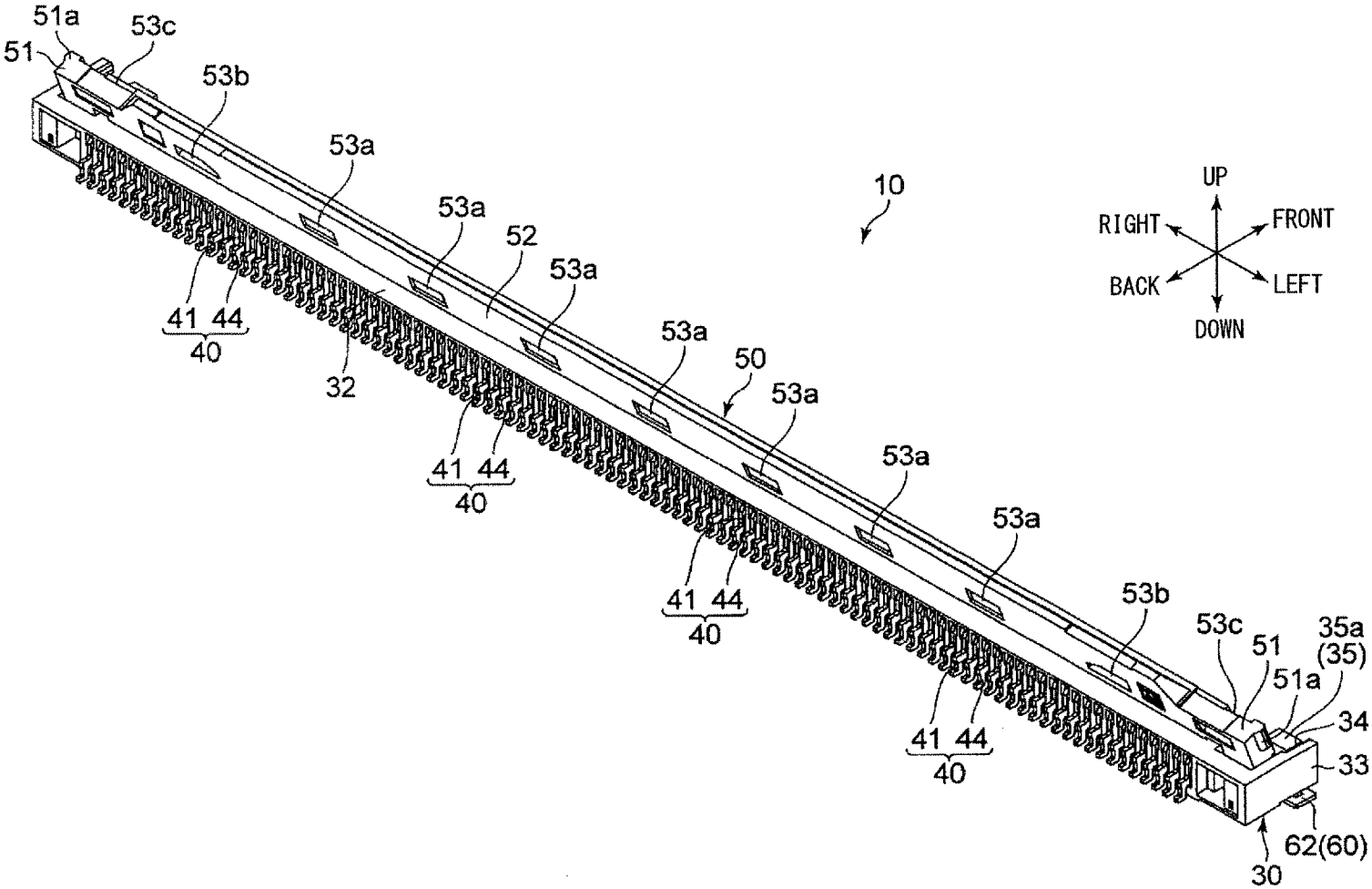
FIG. 3 is a perspective view of the connector with the actuator in a fully open state, as seen from the back.
Figure 4:
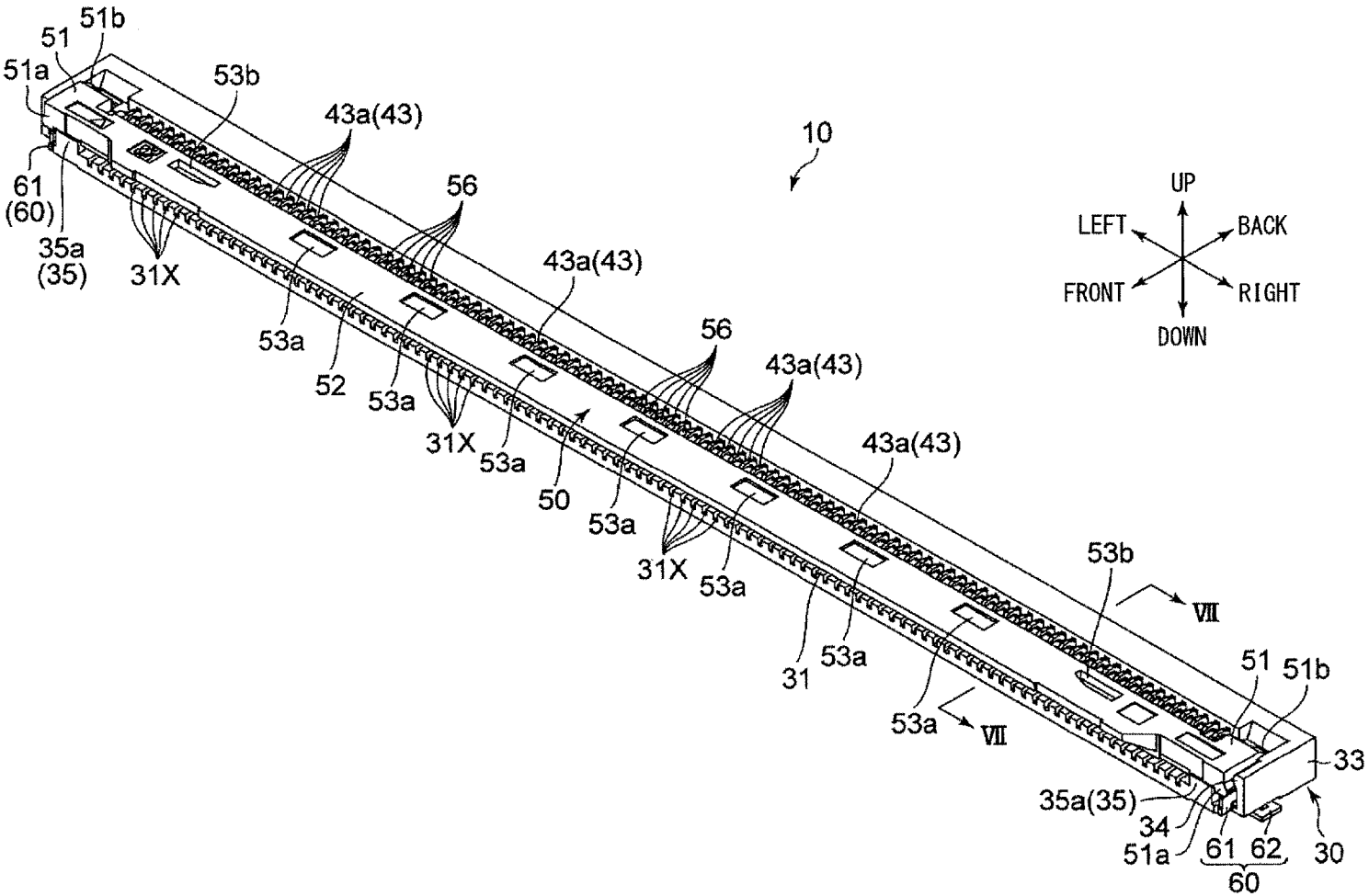
FIG. 4 is a perspective view of the connector with the actuator in a fully closed state, as seen from the front.
Figure 5:
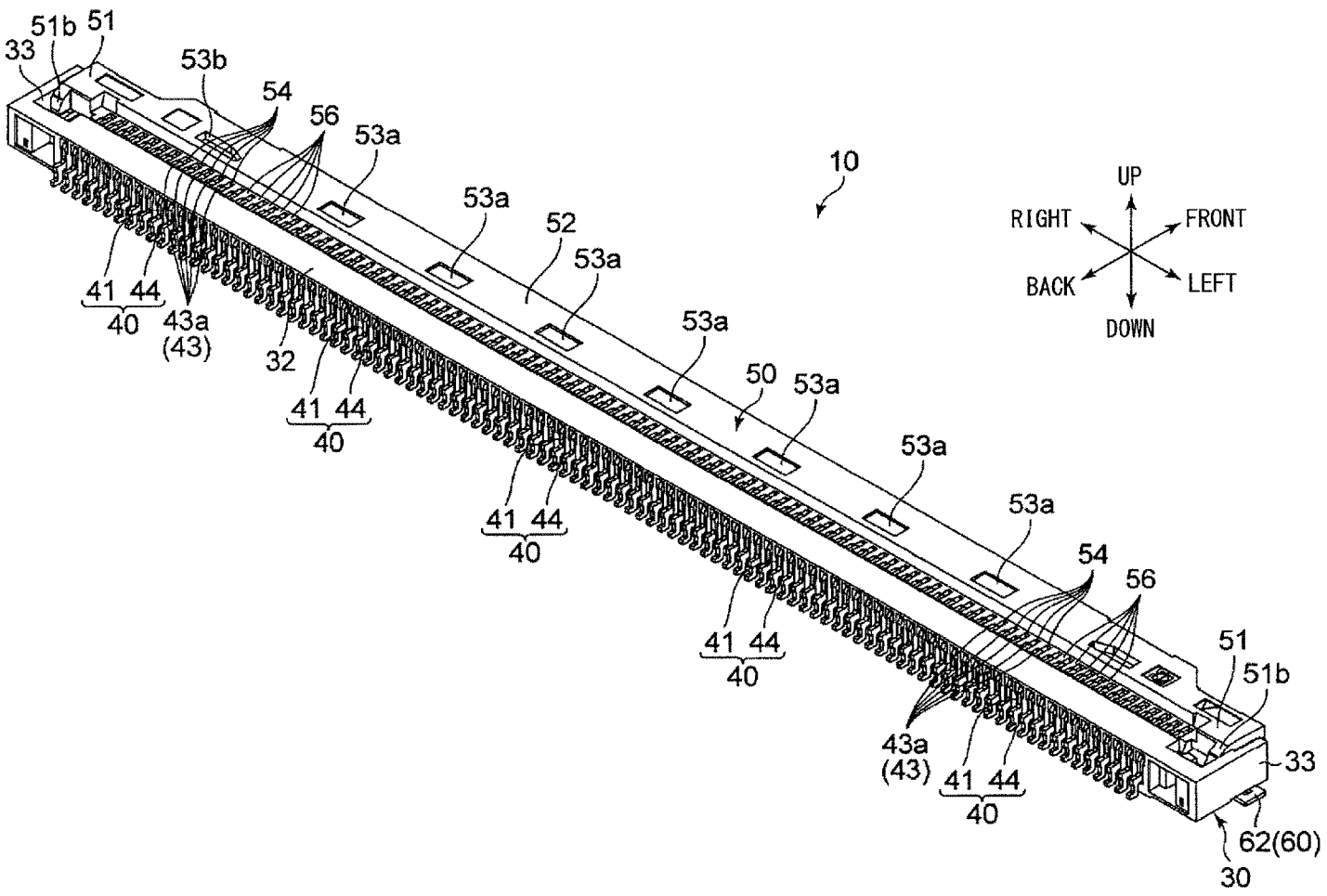
FIG. 5 is a perspective view of the connector with the actuator in a fully closed state, as seen from the back.

The actuator 50 has a pair of upward projecting portion housing recesses (hereafter simply referred to as "housing recesses") 53*c* having an opening at the front end, at the right and left ends of its lower surface (see FIG. 2). In a fully closed state of the actuator 50, the front upward projecting portion 35*a* of the pair of upward projecting portions 35*a* located at the right and left ends of the insulator 30 is housed in and abuts the pair of housing recesses 53*c* of the actuator 50, and thus the position of the actuator 50 is regulated (unwanted rotation (rotation exceeding the fully closed position) is suppressed).

The actuator 50 has 100 press arm insertion grooves (stabilizer insertion grooves) 54 passing through the actuator 50 in the plate thickness direction and arranged side by side in the right-left direction (predetermined direction), at its back end. Inside the 100 press arm insertion grooves 54, 100 catching rotation shafts 55 are arranged side by side in the right-left direction (predetermined direction). By inserting the press arms 43 of the 100 contacts 40 into the 100 press arm insertion grooves 54 and also hooking the rotation shaft support portions 43*a* of the 100 contacts 40 on the 100 catching rotation shafts 55 to be caught by the 100 catching rotation shafts 55, the actuator 50 is supported by the insulator 30 so as to be rotatable (openable/closable). 100 opening angle regulation portions 54*a* for regulating the opening angle in a fully open state of the actuator 50 are formed inside the 100 press arm insertion grooves 54.

The actuator 50 has an interpolar wall 56 between the 100 press arm insertion grooves 54 and the catching rotation shafts 55 and the 100 contacts 40 inserted into and supported by them. Thus, the interpolar wall 56 is located between adjacent contacts 40 of the 100 contacts 40 to separate them.

As illustrated in FIGS. 6, 7, etc., each interpolar wall 56 has an open surface 56O, a closed surface 56C, a sloped connection surface 56S connecting the open surface 56O and the closed surface 56C, and a tip load transmission portion 56L located at the intersection of the closed surface 56C and the sloped connection surface 56S. The intersection of the closed surface 56C and the sloped connection surface 56S is a small R-shaped portion, and the tip part of the R-shaped portion is the tip load transmission portion 56L. The sloped connection surface 56S intersects with the open surface 56O at an obtuse angle, and intersects with the closed surface 56C at an approximately right angle.

The pair of fixed metal fittings 60 are obtained by press forming a metal plate, and includes a press-fit support portion 61 press-fit supported by the pair of fixed metal fitting support grooves 36 of the insulator 30 from below, and a tail portion 62 to be soldered to a circuit board (not illustrated) on which the connector 10 is to be mounted.

Behavior when inserting the connection object 20 into the connector 10 in a fully open state of the actuator 50 and changing the actuator 50 to a fully closed state is described in detail below, with reference to FIGS. 8 to 14.

Figure 8:
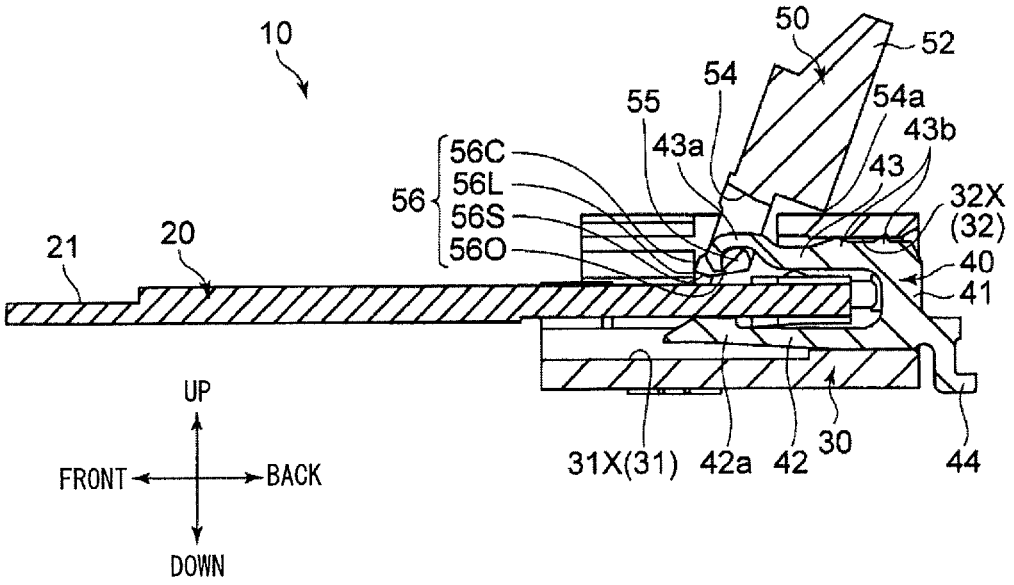
FIG. 8 is a first view illustrating behavior when inserting the connection object into the connector with the actuator in a fully open state and changing the actuator to a fully closed state.

In a fully open state of the actuator 50 illustrated in FIG. 8, the pair of R-shaped portions 51*b* of the actuator 50 are located along the pair of sloped surfaces 37 of the insulator 30, and the 100 opening angle regulation portions 54*a* of the actuator 50 abut the upper surface of the roof portion 32 of the insulator 30, so that the opening angle of the actuator 50 exceeds 90° (e.g. about 110°. By inserting the connection object 20 into the insertion portion 31 of the insulator 30 and engaging the pair of engaging pieces 22 of the connection object 20 with the pair of engaging portions 35*b* of the insulator 30 in the fully open state of the actuator 50, the connection object 20 is prevented from separating from the insulator 30. Here, the open surface 56O of the interpolar wall 56 does not interfere with the connection object 20, and enables insertion of the connection object 20 into the insertion portion 31 of the insulator 30 with zero insertion force (ZIF). Once the connection object 20 has been inserted into the insertion portion 31 of the insulator 30, the open surface 56O of the interpolar wall 56 faces the upper surface of the connection object 20. The support arm 42 of the contact 40 is in a free state without elastic deformation, and the lower surface of the connection object 20 is supported by (placed on) the upper end surface of the contact portion 42*a*. The intersection of the open surface 56O and the sloped connection surface 56S of the actuator 50 is located directly above the upper surface of the connection object 20, where the intersection and the upper surface of the connection object 20 are not in contact with each other. After inserting the connection object 20 into the insertion portion 31 of the insulator 30, a rotation force in the counterclockwise direction in the drawing is applied to the actuator 50 via the picking portion 52 using a dedicated jig or by manual operation by an operator, to close the actuator 50.

Figure 9:
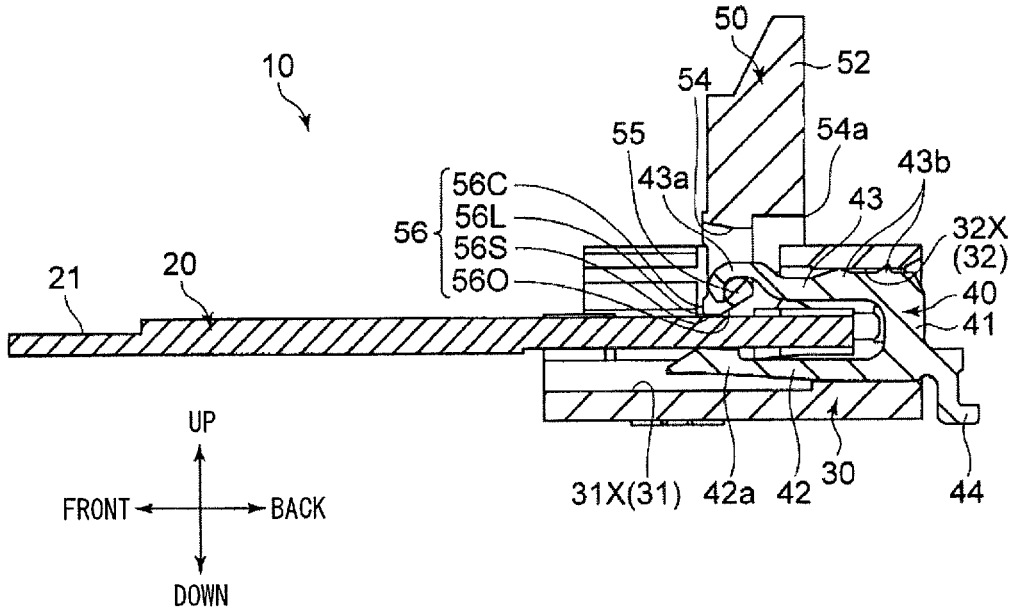
FIG. 9 is a second view illustrating behavior when inserting the connection object into the connector with the actuator in a fully open state and changing the actuator to a fully closed state.

FIG. 9 illustrates a state in which the actuator 50 has been closed by one stage and the opening angle is about 90°. In this state, the sloped connection surface 56S of the interpolar wall 56 elastically contacts and rides onto the upper surface of the connection object 20, as a result of which the catching rotation shaft 55 of the actuator 50 and the rotation shaft support portion 43*a* of the contact 40 supported by the catching rotation shaft 55 are lifted upward. Consequently, the rotation shaft support portion 43*a* of the contact 40 acts on the catching rotation shaft 55 of the actuator 50, and a pressing load to press the actuator 50 toward the connection object 20 inserted in the insertion portion 31 of the insulator 30 is generated. Thus, the 100 circuit patterns (not illustrated) formed on the lower surface of the connection object 20 are pressed toward the contact portions 42*a* of the 100 contacts 40, so that the electrical connection between them is ensured (guaranteed), and also the support arm 42 of the contact 40 (contact portion 42*a*) elastically deforms downward. Here; the catching rotation shaft 55 of the actuator 50 is subjected to a reaction force in a direction to open the actuator 50, by the rotation shaft support portion 43*a* of the contact 40.

Figure 10:
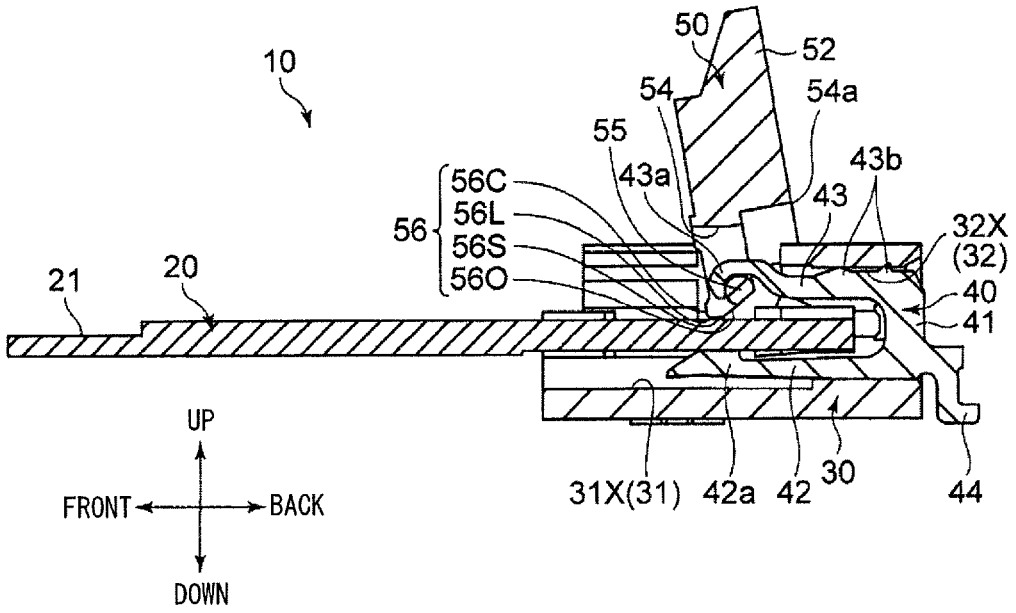
FIG. 10 is a third view illustrating behavior when inserting the connection object into the connector with the actuator in a fully open state and changing the actuator to a fully closed state.

FIG. 10 illustrates a state in which the actuator 50 has been further closed by one stage and the opening angle is about 80°. In this state, the part of the sloped connection surface 56S of the interpolar wall 56 near the tip load transmission portion 56L elastically contacts and further rides onto the upper surface of the connection object 20, as a result of which the catching rotation shaft 55 of the actuator 50 and the rotation shaft support portion 43*a* of the contact 40 supported by the catching rotation shaft 55 are further lifted upward. Consequently, the pressing load applied to the catching rotation shaft 55 of the actuator 50 by the rotation shaft support portion 43*a* of the contact 40 and the pressing load applied to the contact portion 42*a* of the contact 40 from the actuator 50 via the connection object 20 further increase, and the support arm 42 of the contact 40 (contact portion 42*a*) further elastically deforms downward. Here, the catching rotation shaft 55 of the actuator 50 is subjected to a reaction force in the direction to open the actuator 50, by the rotation shaft support portion 43*a* of the contact 40.

Figure 11:
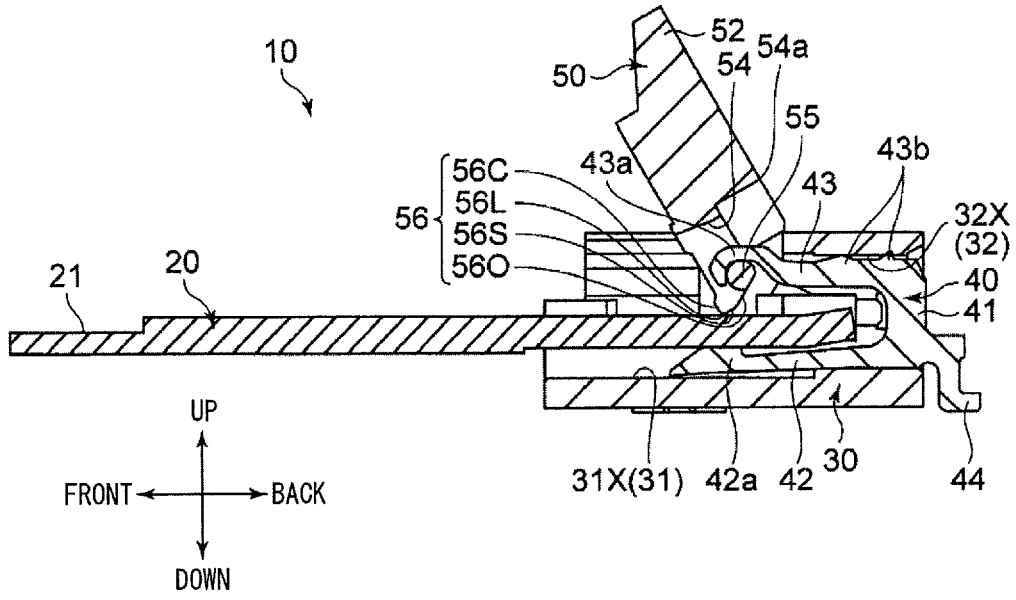
FIG. 11 is a fourth view illustrating behavior when inserting the connection object into the connector with the actuator in a fully open state and changing the actuator to a fully closed state.

FIG. 11 illustrates a state in which the actuator 50 has been further closed by one stage and the opening angle is about 60°. In this state, the part of the sloped connection surface 56S of the interpolar wall 56 nearer the tip load transmission portion 56L (the part near the sloped connection surface 56S in the R-shaped portion located at the intersection of the closed surface 56C and the sloped connection surface 56S) elastically contacts and further rides onto the upper surface of the connection object 20, as a result of which the catching rotation shaft 55 of the actuator 50 and the rotation shaft support portion 43*a* of the contact 40 supported by the catching rotation shaft 55 are further lifted upward. Consequently, the pressing load applied to the catching rotation shaft 55 of the actuator 50 by the rotation shaft support portion 43*a* of the contact 40 and the pressing load applied to the contact portion 42*a* of the contact 40 from the actuator 50 via the connection object 20 further increase, and the support arm 42 of the contact 40 (contact portion 42*a*) further elastically deforms downward. In this state, the reaction force in the direction to open the actuator 50, which has been applied to the catching rotation shaft 55 of the actuator 50 from the rotation shaft support portion 43*a* of the contact 40, becomes zero momentarily.

Figure 12:
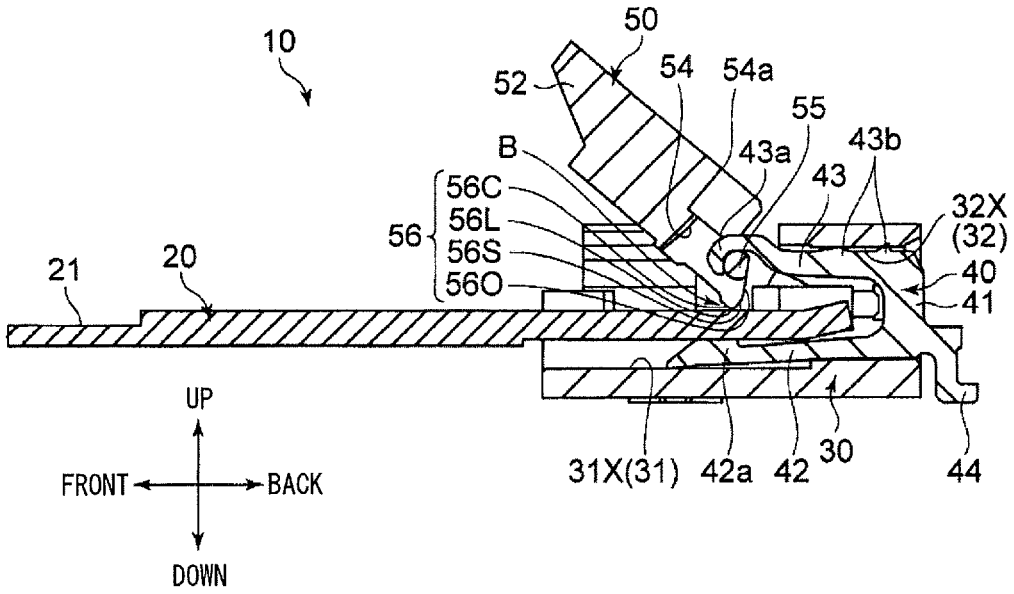
FIG. 12 is a fifth view illustrating behavior when inserting the connection object into the connector with the actuator in a fully open state and changing the actuator to a fully closed state.

FIG. 12 illustrates a state in which the actuator 50 has been further closed by one stage and the opening angle is about 38°. In this state, the tip load transmission portion 56L of the interpolar wall 56 elastically contacts and further rides onto the upper surface of the connection object 20 (maximum ride amount), as a result of which the catching rotation shaft 55 of the actuator 50 and the rotation shaft support portion 43*a* of the contact 40 supported by the catching rotation shaft 55 are further lifted upward (maximum lift amount). Consequently, the pressing load applied to the catching rotation shaft 55 of the actuator 50 by the rotation shaft support portion 43*a* of the contact 40 and the pressing load applied to the contact portion 42*a* of the contact 40 from the actuator 50 via the connection object 20 reach a peak, and the support arm 42 of the contact 40 (contact portion 42*a*) further elastically deforms downward (maximum deformation amount).

A force in a direction to close the actuator 50 then starts to act on the catching rotation shaft 55 of the actuator 50 from the rotation shaft support portion 43*a* of the contact 40. That is, upon reaching the peak of the pressing load applied to the catching rotation shaft 55 of the actuator 50 from the rotation shaft support portion 43*a* of the contact 40, the direction of the rotation force exerted on the catching rotation shaft 55 of the actuator 50 by the rotation shaft support portion 43*a* of the contact 40 is instantaneously switched from the direction to open the actuator 50 to the direction to close the actuator 50. In a state in which the tip load transmission portion 56L of the interpolar wall 56 is in elastic contact with the upper surface of the connection object 20, a wedged space B is formed between the closed surface 56C of the interpolar wall 56 and the upper surface of the connection object 20. This wedged space B does not hamper (interfere with) the switching of the rotation force from the direction to open the actuator 50 to the direction to close the actuator 50.

Figure 13:
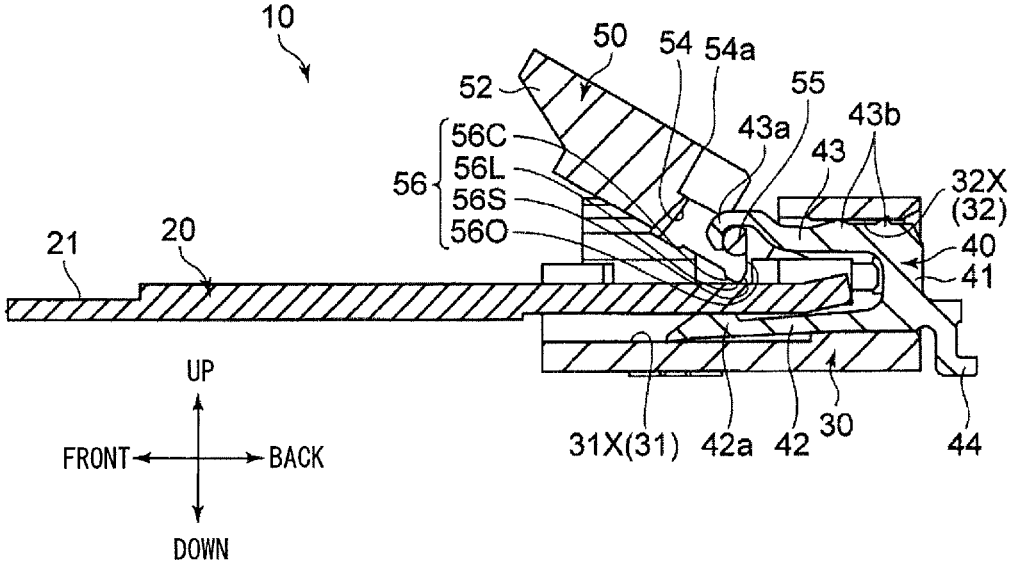
FIG. 13 is a sixth view illustrating behavior when inserting the connection object into the connector with the actuator in a fully open state and changing the actuator to a fully closed state.

FIG. 13 illustrates a state in which the actuator 50 has been further closed by one stage and the opening angle is about 30°. In this state, the part of the closed surface 56C of the interpolar wall 56 nearer the tip load transmission portion 56L (the part near the closed surface 56C in the R-shaped portion located at the intersection of the closed surface 56C and the sloped connection surface 56S) elastically contacts and rides onto the upper surface of the connection object 20. The ride amount of the closed surface 56C of the interpolar wall 56 on the upper surface of the connection object 20 and the upward lift amount of the catching rotation shaft 55 of the actuator 50 and the rotation shaft support portion 43*a* of the contact 40 supported by the catching rotation shaft 55 both decrease a little, as compared with the peak time of FIG. 12. The open surface 56O of the interpolar wall 56 is in an intermediate open/close state in which it is approximately orthogonal to the upper surface of the connection object 20, and the tip load transmission portion 56L of the interpolar wall 56 is located (directly) below the catching rotation shaft 55. Here, the catching rotation shaft 55 of the actuator 50 is subjected to a rotation force in the direction to close the actuator 50, by the rotation shaft support portion 43*a* of the contact 40.

Figure 14:
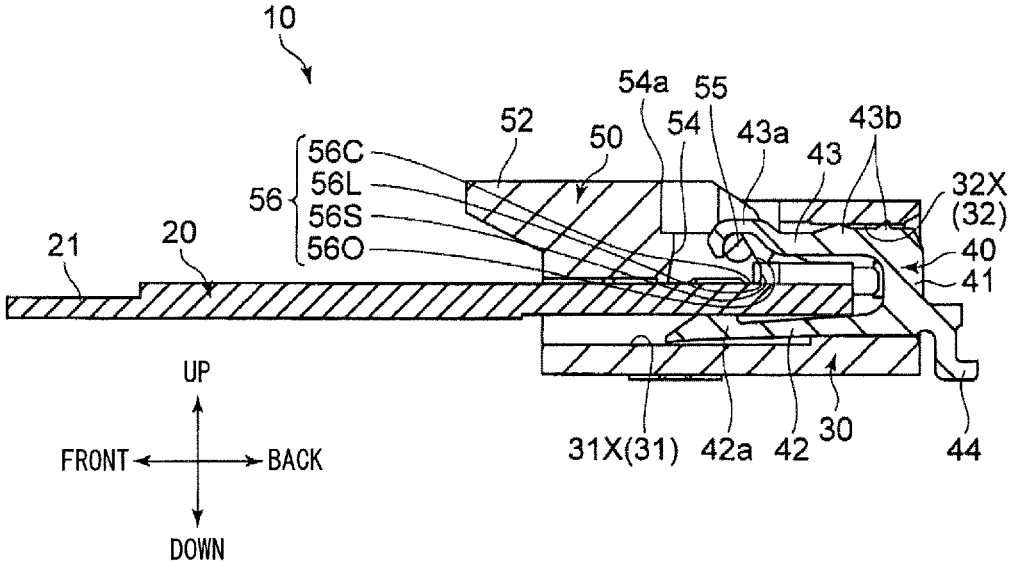
FIG. 14 is a seventh view illustrating behavior when inserting the connection object into the connector with the actuator in a fully open state and changing the actuator to a fully closed state.

FIG. 14 illustrates a fully closed state of the actuator 50. Immediately before the fully closed state, since the upper end surface of the contact portion 42*a* of the contact 40 assumes a valley shape made up of the front sloped surface, the back sloped surface, and the recess connecting them, the back end rising portion of the contact portion 42*a* of the contact 40 pushes the actuator 50 up, thus achieving an effect of further increasing its closing speed. In the fully closed state of the actuator 50, the closed surface 56C of the interpolar wall 56 is approximately parallel to the upper surface of the connection object 20. Moreover, the pair of supported portions 51 of the actuator 50 are supported by the pair of actuator support portions 35 of the insulator 30 and the pair of engagement projections 51*a* of the actuator 50 engage with the pair of engagement projections 34 of the insulator 30, so that the fully closed state of the actuator 50 is maintained. The elastic deformation amount of the support arm 42 of the contact 40 (contact portion 42*a*) decreases a little, as compared with the peak time of FIG. 12.

The connector 10 has, in the interpolar wall 56 of the actuator 50, the sloped connection surface 56S connecting the open surface 56O and the closed surface 56C, and the tip load transmission portion 56L located at the intersection of the closed surface 56C and the sloped connection surface 56S. Hence, when changing the actuator 50 from a fully closed state to a fully open state, an interval during which the tip part of the interpolar wall 56 is not in contact with the upper surface of the connection object 20 and no pressing load is placed is long, and so the sliding distance between the tip part of the interpolar wall 56 and the upper surface of the connection object 20 can be reduced. In addition, the interval and amount of the tip part of the interpolar wall 56 elastically contacting and riding onto the upper surface of the connection object 20 can be reduced. As a result, the operability of the actuator 50 can be improved and the operation force can be reduced while maintaining the basic performance of the connector 10.

When changing the actuator 50 from a fully closed state to a fully open state, upon reaching the peak of the pressing load applied to the catching rotation shaft 55 of the actuator 50 from the rotation shaft support portion 43*a* of the contact 40, the direction of the rotation force exerted on the catching rotation shaft 55 of the actuator 50 by the rotation shaft support portion 43*a* of the contact 40 is instantaneously switched from the direction to open the actuator 50 to the direction to close the actuator 50. Moreover, the wedged space B formed between the closed surface 56C of the interpolar wall 56 and the upper surface of the connection object 20 does not hamper (interfere with) the switching of the rotation force from the direction to open the actuator 50 to the direction to close the actuator 50. Hence, the speed (acceleration) of closing the actuator 50 from the opening angle (FIG. 12) at the peak of the pressing load to the fully closed state (FIG. 14) can be increased. It only suffices to close the actuator 50 to the opening angle (FIG. 12) at the time of the peak of the pressing load. Subsequently, the actuator 50 is at once automatically closed and automatically held in the fully closed state reliably.

Since the speed (acceleration) of automatically closing the actuator 50 is high, when the lower surface of the actuator 50 impacts the upper surface of the connection object 20 and/or the front upward projecting portion 35*a* of the pair of upward projecting portions 35*a* located at the right and left ends of the insulator 30 impacts the pair of housing recesses 53*c* of the actuator 50, a very loud and high pitched automatic closing completion sound (collision sound, clicking sound) is generated. With such automatic closing completion sound (collision sound, clicking sound), it is possible to aurally recognize that the actuator 50 has changed to a fully closed state even in a noisy factory, so that operation can be performed advantageously.

In the tip part of the interpolar wall of a conventional actuator, the angle between the open surface and the closed surface is the same as that in this embodiment, the tip load transmission portion is formed at the intersection of the open surface and the closed surface (the sloped connection surface is not present), and the distance between the catching rotation shaft to the tip part of the interpolar wall is greater. Accordingly, when changing the actuator from a fully closed state to a fully open state, the tip part of the interpolar wall comes into contact with the upper surface of the connection object and the pressing load is exerted in an early stage, and furthermore this interval is continued for a long time. This causes an increase of the sliding distance between the tip part of the interpolar wall and the upper surface of the connection object. Further, the interval and amount of the interpolar wall elastically contacting and riding onto the upper surface of the connection object increase. As a result, an excessively high resistance acts between the interpolar wall and the connection object, and the actuator does not close automatically. To put the actuator in the fully closed state, the operator needs to manually press the picking portion of the actuator. This causes poor actuator operability. Moreover, no automatic closing completion sound (collision sound, clicking sound) of the actuator is generated.

Although the foregoing embodiment describes the case where all of the plurality of interpolar walls 56 are provided with the open surface 56O, the closed surface 56C, the sloped connection surface 56S, and the tip load transmission portion 56L, only some of the plurality of interpolar walls 56 may be provided with the open surface 56O, the closed surface 56C, the sloped connection surface 56S, and the tip load transmission portion 56L. For example, the open surface 56O, the closed surface 56C, the sloped connection surface 56S, and the tip load transmission portion 56L may be provided to every other interpolar wall 56, every third interpolar wall 56, every fourth interpolar wall 56, or a combination thereof in the plurality of interpolar walls 56. In this way, even in the case where the contact 40 is multipole, the operation force of the actuator 50 can be reduced, and the automatic closing completion sound (collision sound, clicking sound) can be generated. Alternatively, some of the plurality of interpolar walls 56 may be omitted.

Although the foregoing embodiment describes the case where 100 circuit patterns (not illustrated) of the connection object 20, 100 contact support grooves 31X and 100 contact support grooves 32X of the insulator 30, 100 contacts 40, and 100 press arm insertion grooves 54 and 100 catching rotation shafts 55 of the actuator 50 are each arranged side by side in the right-left direction (predetermined direction), the numbers of these components are not limited to 100, and various design changes are possible.

Although the foregoing embodiment describes the case where the sloped connection surface 56S intersects with the open surface 56O at an obtuse angle and intersects with the closed surface 56C at an approximately right angle, the sloped connection surface 56S may intersect with each of the open surface 56O and the closed surface 56C at an obtuse angle.

REFERENCE SIGNS LIST

10 connector
20 connection object
21 thin portion
22 engaging piece
30 insulator
31 insertion portion
31X contact support groove
32 roof portion
32X contact support groove
33 side wall
34 engagement projection
35 actuator support portion
35*a* upward projecting portion
35*b* engaging portion
36 fixed metal fitting support groove
37 sloped surface
40 contact
41 base piece
42 connection object support arm (support arm)
42*a* contact portion
43 press arm (stabilizer)

43*a* rotation shaft support portion (elastic pressing portion)
43*b* engaging protrusion
44 tail portion
50 actuator
51 supported portion
51*a* engagement projection
51*b* R-shaped portion
52 picking portion
53*a* rectangular recess
53*b* trapezoidal recess
53*c* upward projecting portion housing recess (housing recess)
54 press arm insertion groove (stabilizer insertion groove)
54*a* opening angle regulation portion
55 catching rotation shaft
56 interpolar wall
56O open surface
56C closed surface
56S sloped connection surface
56L tip load transmission portion
60 fixed metal fitting
61 press-fit support portion
62 tail portion
B wedged space

The invention claimed is:

1. A connector comprising:

an insulator having an insertion portion into which a flat connection object is inserted;

a contact supported by said insulator, and electrically connectable to said connection object inserted in said insertion portion;

an actuator rotatably supported by said insulator, and having an open surface that enables insertion of said connection object into said insertion portion in an open state, and a closed surface approximately parallel to said connection object in a closed state; and an elastic pressing portion that acts on a rotation shaft of said actuator, to press said actuator toward said connection object inserted in said insertion portion, wherein said actuator has: a sloped connection surface that connects said open surface and said closed surface; and a tip load transmission portion that is located at an intersection of said closed surface and said sloped connection surface, and elastically contacts said connection object at a time at which a pressing load imparted by said elastic pressing portion is at a peak, and wherein in said open state of said actuator, said open surface extends only up to an end of said rotation shaft of said actuator in the direction into which said flat connection object is inserted, and said actuator comprises a cut out into which a roof portion of said insulator extends in said open state of said actuator.

2. The connector according to claim 1, wherein, when changing said actuator from said open state to said closed state, said tip load transmission portion is located below said rotation shaft of said actuator in an intermediate open/close state in which said open surface is approximately orthogonal to said connection object.

3. The connector according to claim 1, wherein said sloped connection surface intersects with said open surface at an obtuse angle, and intersects with said closed surface at an approximately right angle.

4. The connector according to claim 1, wherein said sloped connection surface intersects with each of said open surface and said closed surface at an obtuse angle.

5. The connector according to claim 1, wherein said contact includes a plurality of contacts arranged side by side in a predetermined direction, and said open surface, said closed surface, said sloped connection surface, and said tip load transmission portion of said actuator are provided in a plurality of interpolar walls located between adjacent contacts in said plurality of contacts.

6. The connector according to claim 5, wherein said open surface, said closed surface, said sloped connection surface, and said tip load transmission portion of said actuator are provided on all of said plurality of interpolar walls.

7. The connector according to claim 5, wherein said open surface, said closed surface, said sloped connection surface, and said tip load transmission portion of said actuator are provided on some of said plurality of interpolar walls.

8. The connector according to claim 1, wherein said open surface enables the insertion of said connection object into said insertion portion with a zero insertion force (ZIF) in said open state.

* * * * *